US009531112B2

(12) United States Patent
Kato et al.

(10) Patent No.: US 9,531,112 B2
(45) Date of Patent: Dec. 27, 2016

(54) ROTARY CONNECTOR

(71) Applicant: Yazaki Corporation, Minato-ku, Tokyo (JP)

(72) Inventors: Hajime Kato, Kakegawa (JP); Hiroaki Imai, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/896,033

(22) PCT Filed: Jun. 27, 2014

(86) PCT No.: PCT/JP2014/067259
§ 371 (c)(1),
(2) Date: Dec. 4, 2015

(87) PCT Pub. No.: WO2015/002107
PCT Pub. Date: Jan. 8, 2015

(65) Prior Publication Data

US 2016/0134048 A1 May 12, 2016

(30) Foreign Application Priority Data

Jul. 2, 2013 (JP) ..... 2013-139098

(51) Int. Cl.
*H01R 13/62* (2006.01)
*H01R 13/52* (2006.01)
(Continued)

(52) U.S. Cl.
CPC ..... *H01R 13/5205* (2013.01); *H01R 13/502* (2013.01); *H01R 13/625* (2013.01);
(Continued)

(58) Field of Classification Search
CPC ..... H01R 13/625
See application file for complete search history.

(56) References Cited

U.S. PATENT DOCUMENTS 3,112,976 A * 12/1963 Knight ..... H01R 13/625 439/335
5,685,730 A 11/1997 Cameron et al.

FOREIGN PATENT DOCUMENTS

JP 59-170382 U 11/1984
JP 1-170966 U 12/1989
(Continued)

OTHER PUBLICATIONS

International Search Report dated Aug. 12, 2014 issued in International Application No. PCT/JP2014/067259 (PCT/ISA/210).
(Continued)

*Primary Examiner* — Tho D Ta
(74) *Attorney, Agent, or Firm* — Sughrue Mion, PLLC

(57) ABSTRACT

A second connector housing connected to a first connector housing includes: a second housing body (31) including a cylinder portion (312) into which a body portion (212) is fitted; an axial groove (315*a*) formed by a cut in the cylinder portion (312) and allowing a connection pin (214) to enter therein, a circumferential groove (315*b*) arranged to extend circumferentially in the cylinder portion (312) from a distal end of the axial groove (315*a*), and allowing the connection pin (214) to move therein when the connector housings are operated and rotated relatively to each other; and a lock spring piece (316) formed integrally with the cylinder portion (312) to extend along the circumferential groove (315*b*), and restricting the connection pin (214) from moving in a return direction in a state in which the connection piece (214) arrives at distal end of the circumferential groove (315*b*).

4 Claims, 11 Drawing Sheets

(51) Int. Cl.

| | |
|---|---|
| ***H01R 13/625*** | (2006.01) |
| ***H01R 13/502*** | (2006.01) |
| ***H01R 39/00*** | (2006.01) |
| *H01R 13/627* | (2006.01) |
| *H01R 101/00* | (2006.01) |
| *H01R 13/24* | (2006.01) |

(52) U.S. Cl.
CPC ..... *H01R 39/00* (2013.01); *H01R 13/2492* (2013.01); *H01R 13/5202* (2013.01); *H01R 13/5221* (2013.01); *H01R 13/6278* (2013.01); *H01R 2101/00* (2013.01)

(56) References Cited

FOREIGN PATENT DOCUMENTS

| | | | |
|---|---|---|---|
| JP | 5-48249 | U | 6/1993 |
| JP | 7-263082 | A | 10/1995 |
| JP | 8-293355 | A | 11/1996 |
| JP | 11-329549 | A | 11/1999 |

OTHER PUBLICATIONS

Written Opinion dated Aug. 12, 2014 issued in International Application No. PCT/JP2014/067259 (PCT/ISA/237).
Written Opinion dated Aug. 12, 2014 issued by the International Searching Authority in counterpart International Application No. PCT/JP2014/067259 (PCT/ISA/237).
Communication dated Sep. 20, 2016 issued by the Japanese Patent Office in counterpart Japanese Patent Application No. 2013-139098.

* cited by examiner

ROTARY CONNECTOR

TECHNICAL FIELD

The present invention relates to a rotary connector in which connector housings fitted to each other can be rotated relatively to each other to thereby lock a connection state between the connector housings.

BACKGROUND ART

FIG. 11 to FIG. 16 show a rotary connector disclosed in the following Patent Document 1.

The rotary connector 100 is provided with a first connector housing 110 and a second connector housing 120. The first connector housing 110 includes a body portion 111 having a circular outer circumference shape in cross section. The second connector housing 120 includes a cylinder portion 121 into which the body portion 111 is fitted.

Connection groove portions 112 are formed at two circumferentially separate places in an outer circumference surface of the body portion 111 of the first connector housing 110. Each of the connection groove portions 112 includes an axial groove 112*a* and a circumferential groove 112*b*. The axial groove 112*a* is arranged to extend along a central axis O1 of the body portion 111 from a distal end portion of the body portion 111. The circumferential groove 112*b* is arranged to extend circumferentially along the body portion 111 from a distal end of the axial groove 112*a*. A large diameter portion 114 which has a substantially column shape concentric to the body portion 111 and which has a larger diameter than the body portion 111 is formed in a proximal end of the body portion 111. As shown in FIG. 11 and FIG. 13, a lock pin 116 is provided in a step face 115 formed in a borderline between the body portion 111 and the large diameter portion 114.

As shown in FIG. 13 and FIG. 14, the lock pin 116 is retained in a pin support hole 115*a* made in the step face 115. The pin support hole 115*a* is formed along the central axis O1 of the body portion 111. The lock pin 116 is slidably fitted into the pin support hole 115*a*. As shown in FIG. 14, coming off of the lock pin 116 received in the pin support hole 115*a* can be prevented by a sleeve 117 pressed into the pin support hole 115*a*. In addition, the lock pin 116 is urged by a compression coil spring 118 in a direction to protrude from the pin support hole 115*a*. The compression coil spring 118 is disposed in a compressed state inside the pin support hole 115*a*.

Due to an urging force of the compression coil spring 118, normally, the lock pin 116 is retained in a state in which a distal end of the lock pin 116 protrudes from the pin support hole 115*a*. The lock pin 116 can be displaced in a state in which the total length of the lock pin 116 is stored inside the pin support hole 115*a* due to compression of the compression coil spring 118.

In the second connector housing 120, connection protrusions 122 are provided protrusively at two places in an inner circumference of a distal end of the cylinder portion 121, and a pin engagement groove 126 is formed in an outer circumference of the distal end of the cylinder portion 121.

The connection protrusions 122 are protrusions engaged with the connection groove portions 112 of the first connector housing 110. When the body portion 111 is fitted into the cylinder portion 121 in a state in which the positions of the connection protrusions 122 are aligned with the positions of the axial grooves 112*a* of the body portion 111, the connection protrusions 122 enter the axial grooves 112*a* and arrive at the distal ends of the axial grooves 112*a*. When the first connector housing 110 and the second connector housing 120 are rotated relatively to each other in this state, the connection protrusions 122 enter the circumferential grooves 112*b* to thereby restrict the connector housings from being displaced axially relatively to each other.

Incidentally, when the cylinder portion 121 and the body portion 111 are fitted to each other axially, the lock pin 116 is pushed into the pin support hole 115*a* by a front end of the cylinder portion 121 such that the total length of the lock pin 116 is stored inside the pin support hole 115*a*.

The pin engagement groove 126 is a groove into which the lock pin 116 stored inside the pin support hole 115*a* plunges as soon as the connection protrusions 122 arrive at distal ends of the circumferential grooves 112*b* due to relative rotation between the connector housings. When the lock pin 116 plunges into the pin engagement groove 126, the connector housings are restricted from rotating relatively to each other such that the connection state between the connector housings is locked.

In the case of the rotary connector 100 described in Patent Document 1, the lock state between the connector housings can be released in the following manner. That is, as shown in FIG. 15, a special tool 130 is wedged into a space in the pin engagement groove 126 to thereby store the lock pin 116 inside the pin support hole 115*a*, as shown in FIG. 16. Then, an operation is performed to rotate the connector housings relatively to each other.

PRIOR ART DOCUMENT(S)

Patent Document(s)

Patent Document 1: U.S. Pat. No. 5,685,730

SUMMARY OF THE INVENTION

Problem to be Solved by the Invention

In the aforementioned rotary connector 100 in Patent Document 1, all the lock pin 116, the sleeve 117 and the compression coil spring 118 used in a mechanism for locking the connection state between the connector housings are independent components provided separately from the connector housings. For this reason, there is a problem that the number of constituent components or the number of assembling steps may increase to thereby cause increase of cost.

In addition, there is also a problem that the special tool 130 is required for releasing the lock, as shown in FIG. 15 and FIG. 16.

In addition, long and narrow components such as the lock pin 116 and the compression coil spring 118 are lined up axially in series in the connector housing. For this reason, the axial length of the connector housing for retaining these components is increased. As a result, there is also a problem that the total length of the connector may become so long that the connector can be poor in mountability on a vehicle in which it is difficult to secure a sufficient installation space.

Therefore, in order to solve the foregoing problems, an object of the invention is to provide a rotary connector in which the number of constituent components can be reduced to thereby reduce cost, connector housings can be attached/detached to/from each other easily without using any tool, and further, the total length of the connector can be shortened to thereby improve mountability of the connector on a vehicle.

Solutions to the Problem

The above-described object of the invention can be achieved by the following configurations.

(1) A rotary connector including:

a first connector housing including:

a first housing body which has a circular outer circumference shape in cross section and which houses a first terminal fitting therein; and a connection pin provided to protrude radially outward from the first housing body; and a second connector housing including:

a second housing body which has a circular outer circumference shape in cross section, into which the first housing body is fitted, and which houses a second terminal fitting connected to the first terminal fitting;

an axial groove which is formed by a cut to extend along a direction of a central axis of the second housing body from an end portion of the second housing body on the first connector housing side, and which allows the connection pin to enter therein when the first housing body is fitted into the second housing body along the direction of the central axis of the second housing body;

a circumferential groove which is arranged to extend circumferentially toward one circumferential side of the second housing body from a distal end of the axial groove, and which allows the connection pin to move therein when the second housing body and the first housing body are rotated relatively to each other; and a lock portion which is provided to protrude into the circumferential groove, and which contacts the connection pin from a start end side of the circumferential groove to restrict the connection pin from moving in a return direction in a state in which the connection pin arrives at a distal end of the circumferential groove, wherein when a pressing force which is not lower than a predetermined value to act toward the start end side of the circumferential groove is given to the lock portion from the connection pin positioned at the distal end of the circumferential groove, the lock portion allows the connection pin to move toward the start end side of the circumferential groove.

(2) The rotary connector according to the configuration of (1), further including:

a first rubber plug which watertightly seals a gap between an outer circumference of an electric wire led to the outside from a proximal end side of the first housing body and a proximal end-side inner circumferential portion of the first housing body;

a second rubber plug which watertightly seals a gap between an outer circumference of an electric wire led to the outside from a proximal end side of the second housing body and a proximal end-side inner circumferential portion of the second housing body; and a packing which is provided in a fitting portion between the first housing body and the second housing body to watertightly seal the fitting portion between the first housing body and the second housing body.

According to the aforementioned configuration (1), the first connector housing and the second connector housing are opposed to each other such that the position of the connection pin of the first housing body is aligned with the position of the axial groove of the second housing body. In this state, the second housing body and the first housing body are made to abut against each other along the direction of the central axis of the second housing body such that the connection pin arrives at the distal end of the axial groove. Then, the housing bodies are rotated relatively to each other such that the connection pin on the first housing body enters the circumferential groove on the second housing body. In this manner, the housing bodies can be restricted from moving axially relatively to each other and the connector housings can be in a state of connection to each other.

Further, the connector housings are rotated relatively to each other until the connection pin arrives at the distal end of the circumferential groove. In this manner, the lock portion elastically contacts the connection pin from the start end side of the circumferential groove to restrict the connection pin from moving in a return direction. Accordingly, the connection state between the connector housings can be locked.

That is, according to the aforementioned configuration (1), the connection state between the connector housings can be locked by the lock portion formed integrally with the second connector housing. In other words, according to the aforementioned configuration (1), no separate component from the connector housings is used for any lock mechanism so that the number of constituent components can be reduced to thereby reduce cost, in comparison with the background-art rotary connector in which a plurality of separate components from the connector housings are used for the lock mechanism.

In addition, according to the aforementioned configuration (1), the lock state can be released in the following manner. That is, in the state in which the connection state between the housing bodies of the connector housings has been locked, a rotation operation force is applied between the housing bodies in an opposite direction to a direction of the force applied for the lock time. When a pressing force not lower than a predetermined value to act toward the start end side of the circumferential groove is applied from the connection pin to the lock portion, the lock state can be released. As a result, the connection pin can move toward the start end side of the circumferential groove. Accordingly, after the connector housings are operated and rotated relatively to each other until the connection pin arrives at the start end of the circumferential groove (i.e. the distal end of the axial groove), the connector housings are pulled apart from each other axially so that the connector housings can be detached from each other.

That is, according to the aforementioned configuration (1), the connector housings can be attached to and detached from each other easily by only axial movement operation and circumferential rotation operation without using any tool.

In addition, according to the aforementioned configuration (1), the lock portion serving as a lock mechanism is arranged to extend circumferentially on the second connector housing so as not to occupy a large axial space in the connector housing. Therefore, the axial length of the second connector housing having the lock portions can be shortened so that the total length of the connector can be shortened. Accordingly, it is also possible to improve mountability of the connector on a vehicle in which it is difficult to secure a sufficient installation space.

Accordingly to the aforementioned configuration (2), in the state in which the connection state between the connector housings is locked, the inside of the connector can be maintained in a waterproof state by the first rubber plug provided at the proximal end of the first connector housing, the packing provided in the fitting portion between the connector housings, and the second rubber plug provided at the proximal end of the second connector housing. Accordingly, the connector can be used satisfactorily also for wiring connection in an engine room etc. requiring waterproofness in a vehicle etc.

Advantages of Invention

According to the rotary connector according to the invention, the number of constituent components can be reduced to thereby reduce cost, the connector housings can be attached to and detached from each other easily without using any tool, and further, the total length of the connector can be shortened to thereby improve mountability of the connector on a vehicle.

The invention has been described above briefly. Further, when a mode (which will be hereinafter referred to as "embodiment") for carrying out the invention which will be described below is read through with reference to the accompanying drawings, the details of the invention can be made further clear.

MODE FOR CARRYING OUT THE INVENTION

A preferred embodiment of a rotary connector according to the invention will be described below in detail with reference to the drawings.

Figure 1:
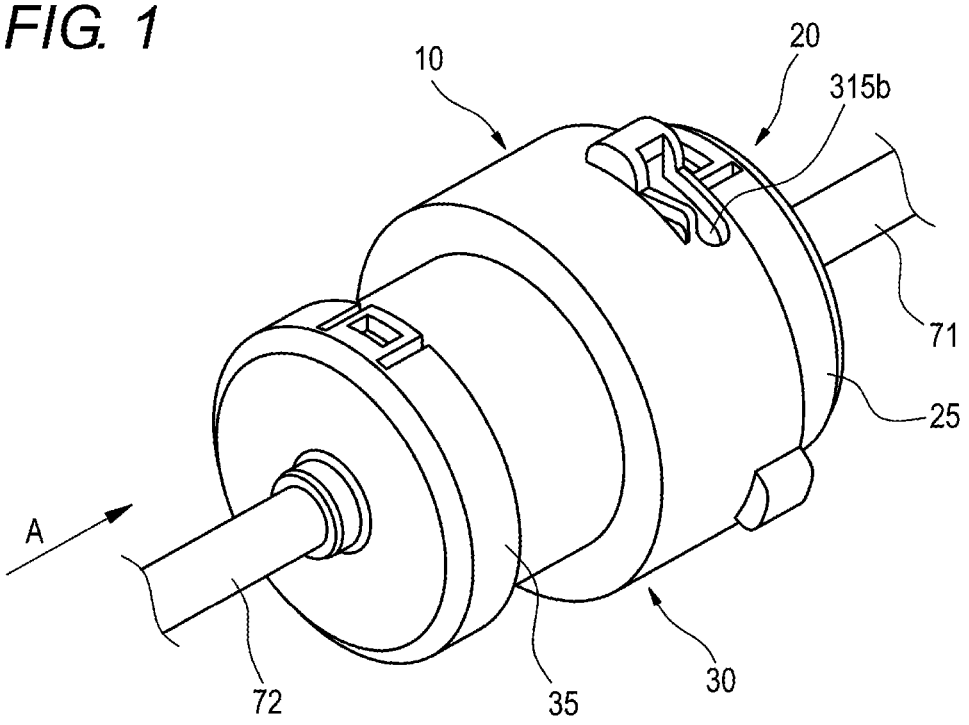
FIG. 1 is a perspective view of an assembled state of an embodiment of a rotary connector according to the invention.
Figure 2:
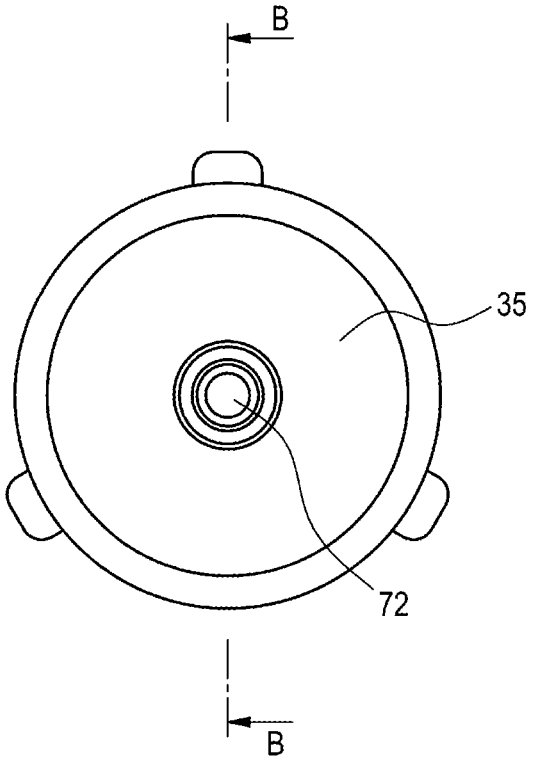
FIG. 2 is a view taken in the direction of an arrow A of FIG. 1.
Figure 3:
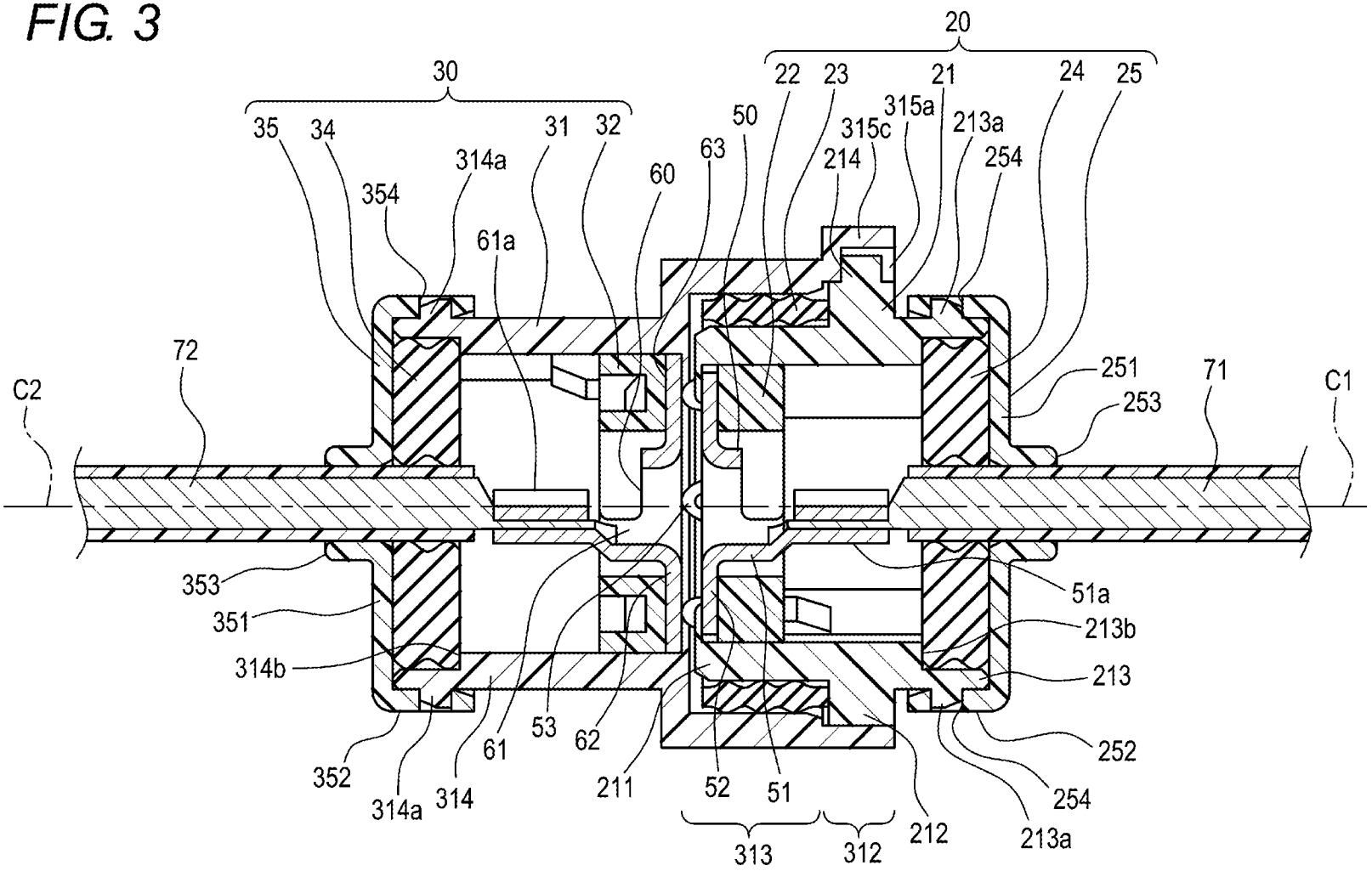
FIG. 3 is a sectional view taken along a line B-B of FIG. 2.
Figure 4:
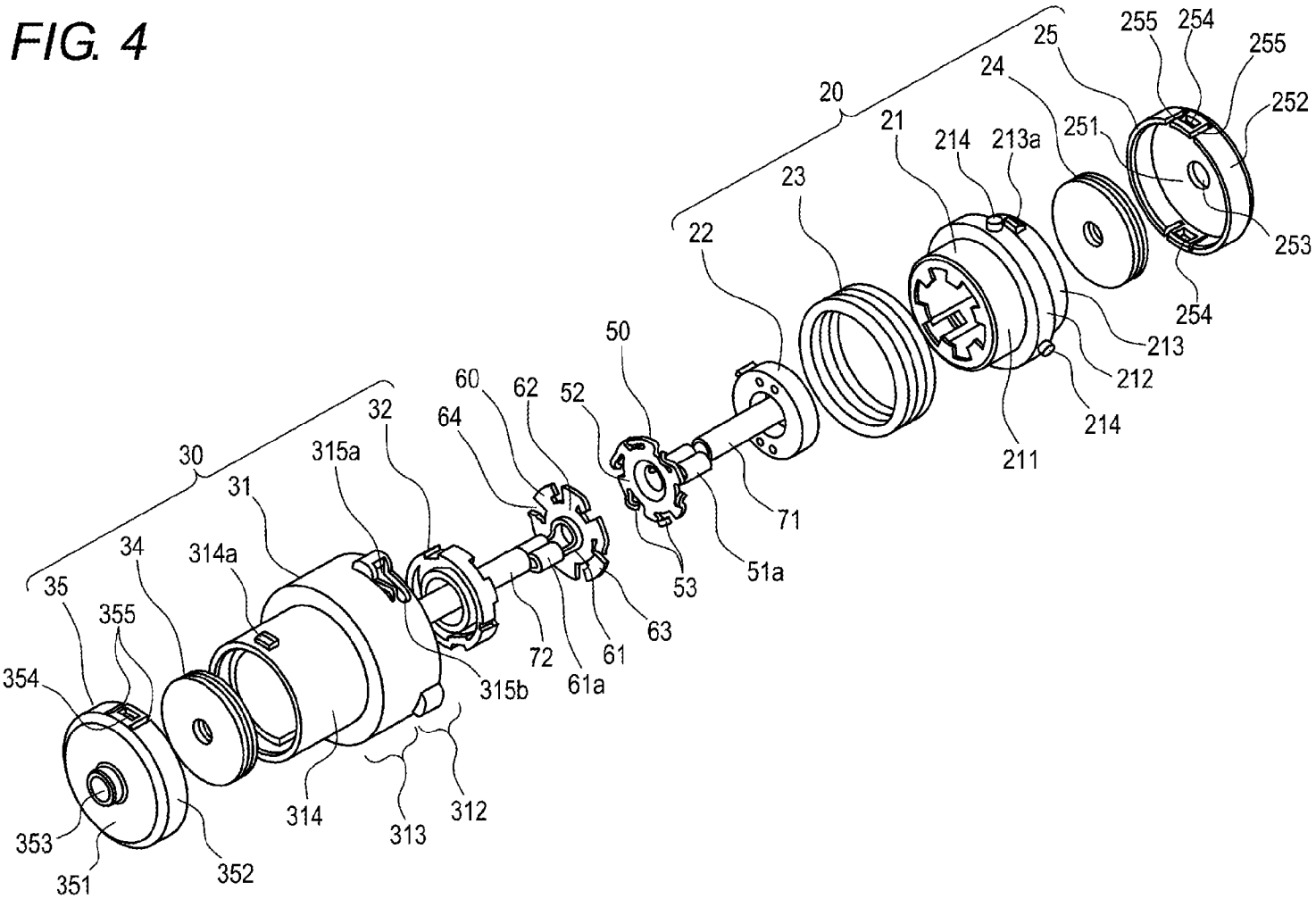
FIG. 4 is an exploded perspective view of the rotary connector according to the embodiment of the invention.
Figure 5:
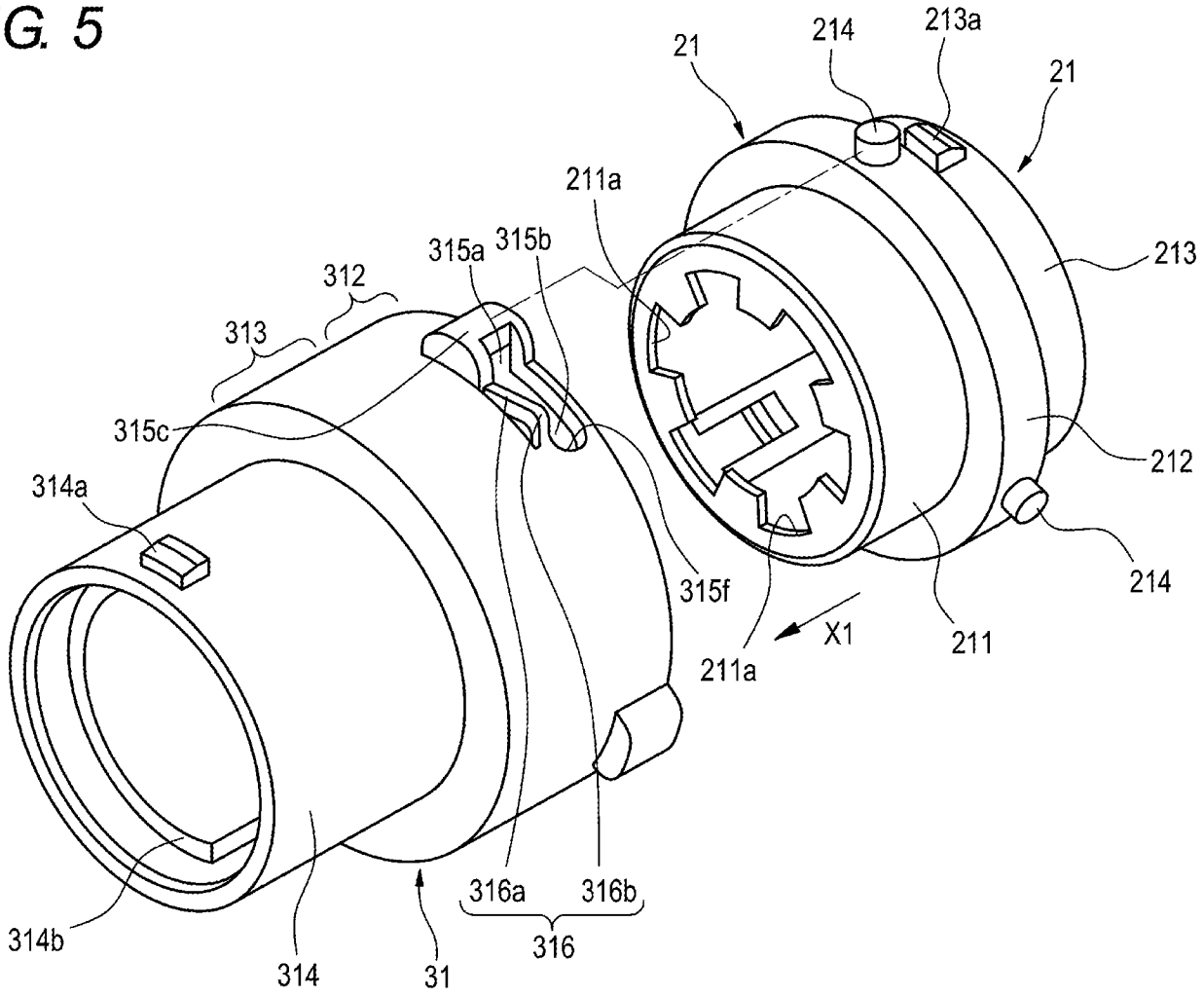
FIG. 5 is a perspective view of a state in which a first connector housing and a second connector housing are opposed to each other in the embodiment of the invention.
Figure 6:
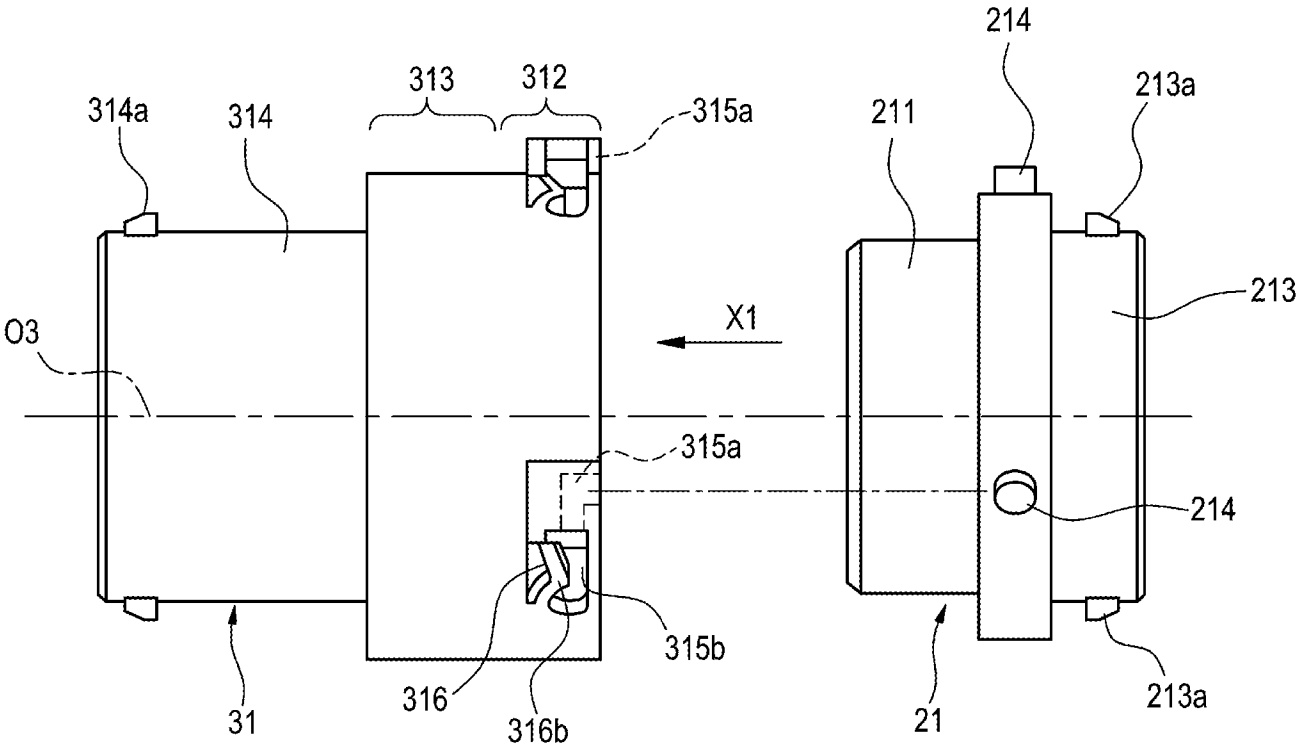
FIG. 6 is a plan view of the state in which the first connector housing and the second connector housing are opposed to each other in the embodiment of the invention.
Figure 7:
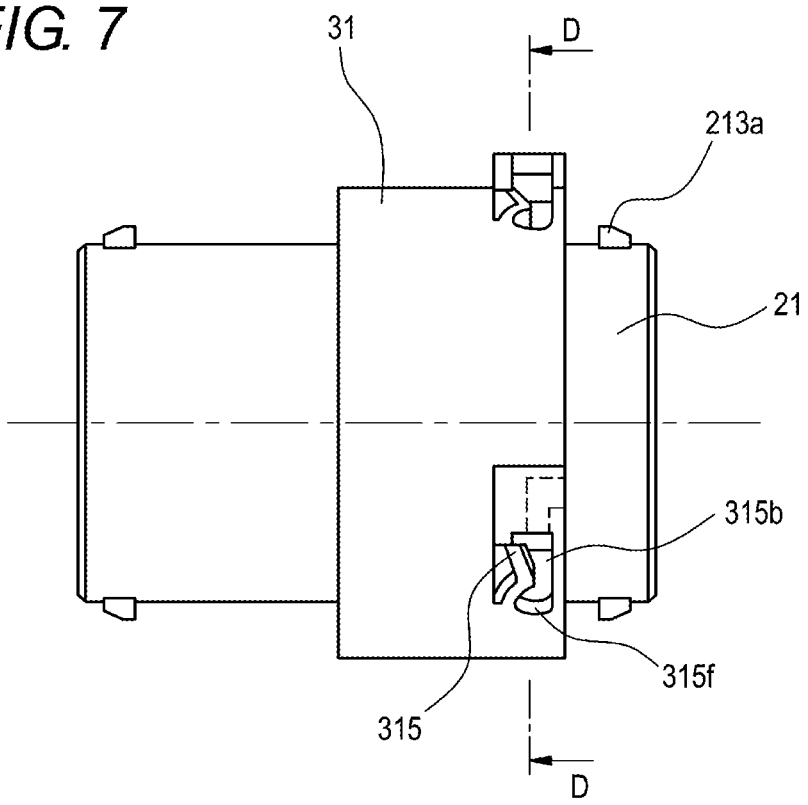
FIG. 7 is an external view of a state in which the connector housings have been fitted to each other axially and connection pins have arrived at distal ends of axial grooves of a second housing body.
Figure 8:
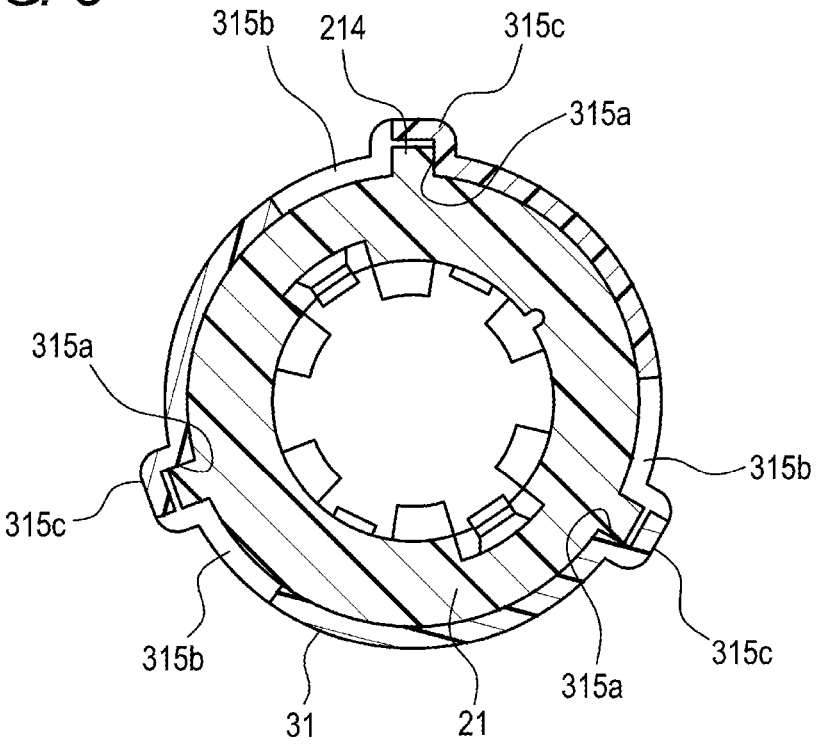
FIG. 8 is a sectional view taken along a line D-D of FIG. 7.
Figure 9:
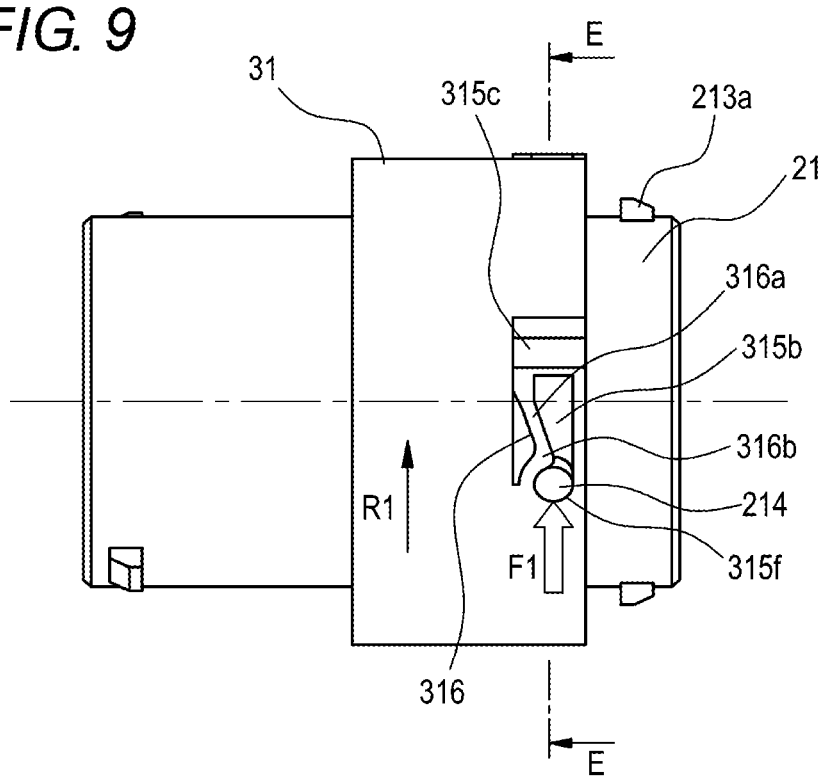
FIG. 9 is an external view of a state in which connection between the connector housings has been locked in the embodiment of the invention.
Figure 10:
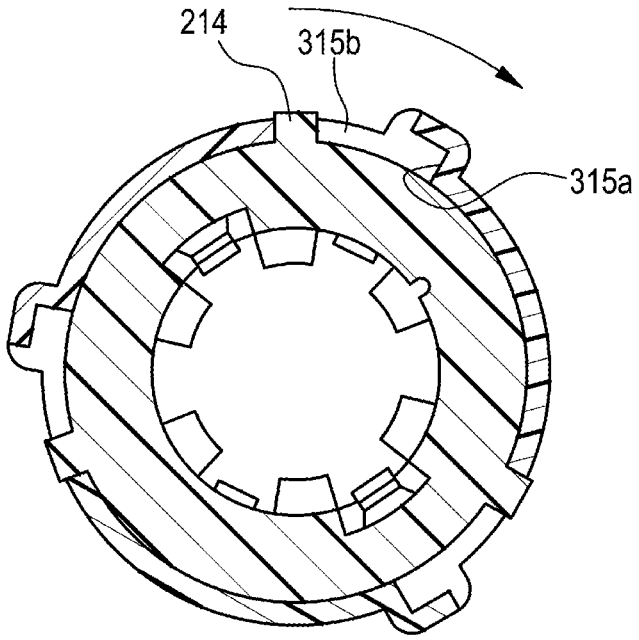
FIG. 10 is a sectional view taken along a line E-E of FIG. 9.
Figure 11:
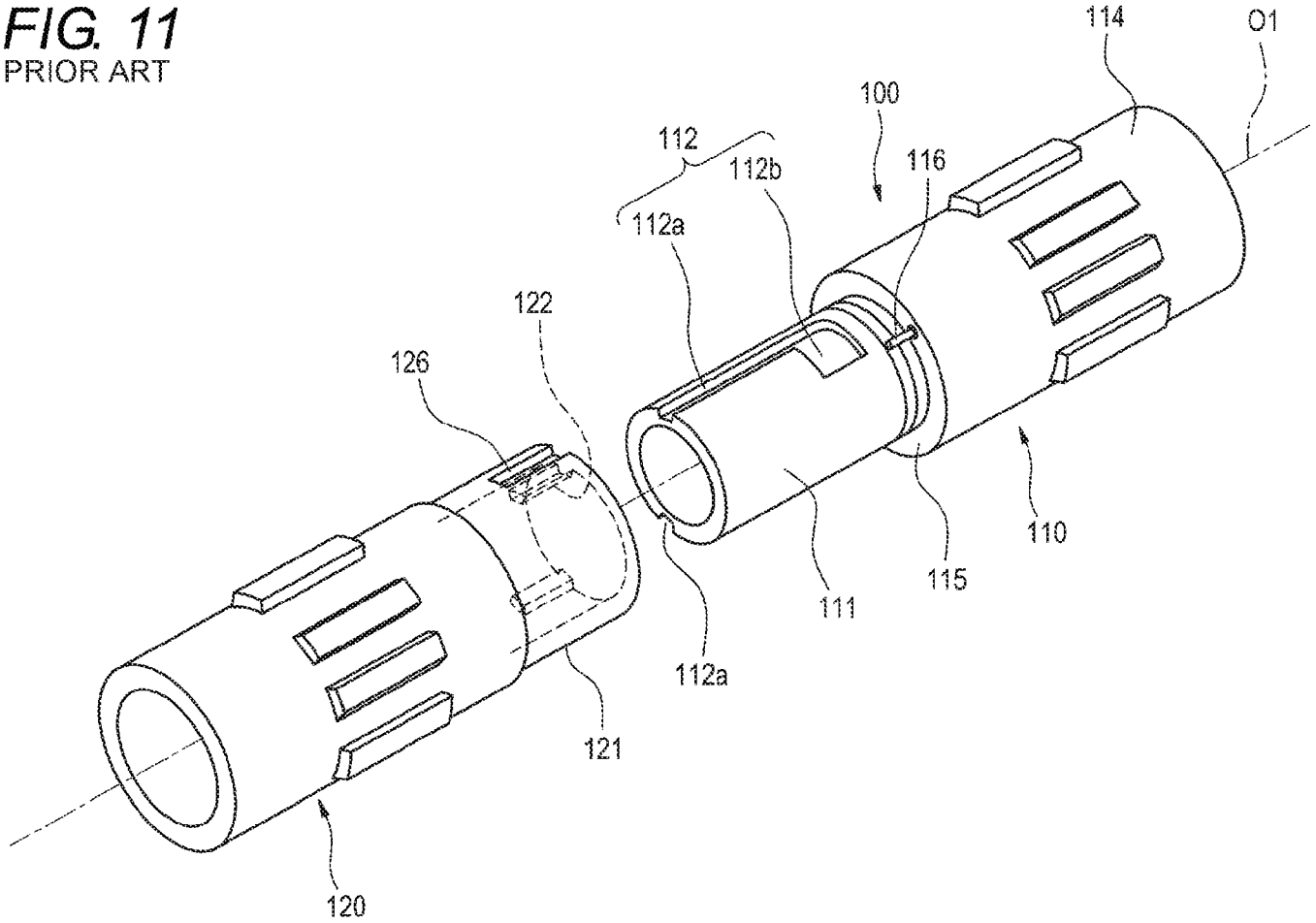
FIG. 11 PRIOR ART
FIG. 11 is an exploded perspective view of a rotary connector according to the background art.
Figure 12:
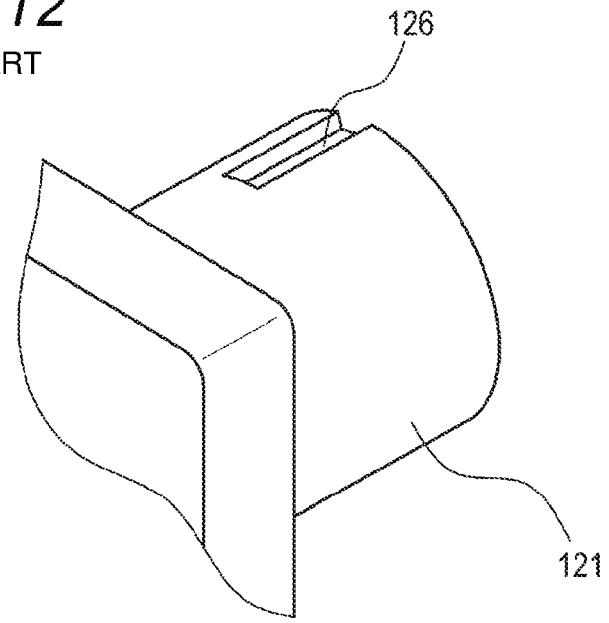
FIG. 12 PRIOR ART
FIG. 12 is an enlarged view of a cylinder portion 121 shown in FIG. 11.
Figure 13:
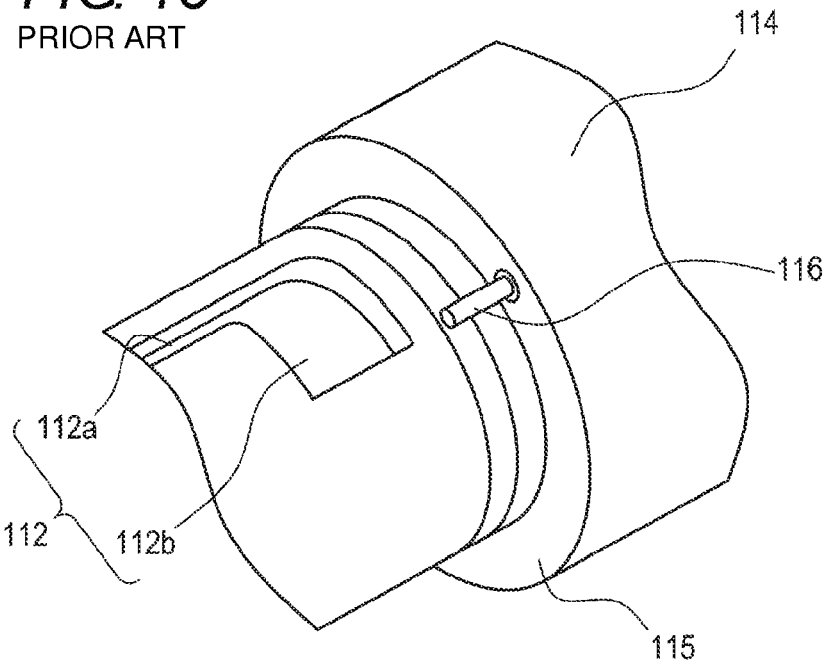
FIG. 13 PRIOR ART
FIG. 13 is an enlarged view of a step face 115 and its periphery shown in FIG. 11.
Figure 14:
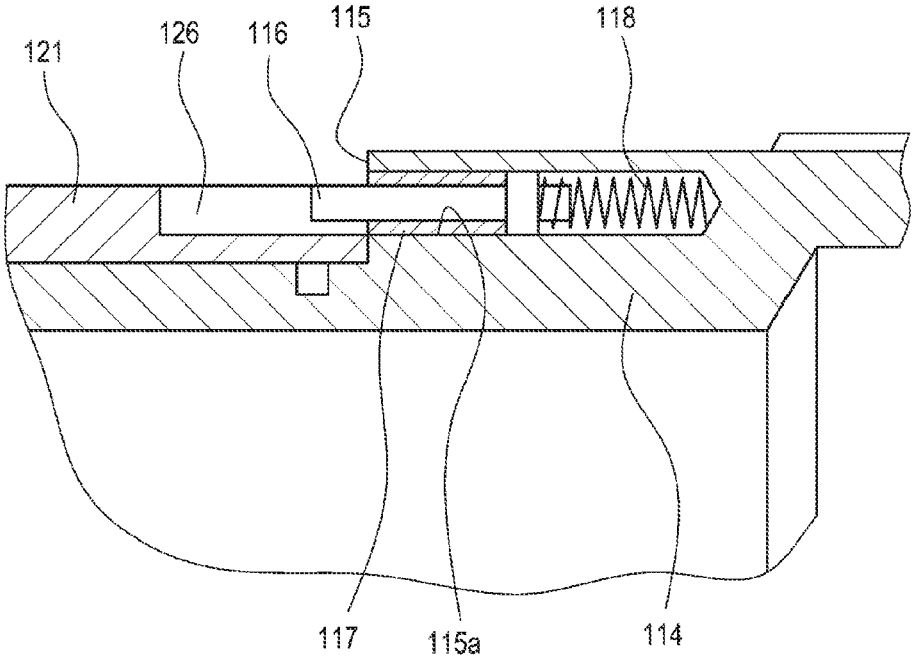
FIG. 14 PRIOR ART
FIG. 14 is an enlarged sectional view showing an attachment structure of a lock pin 116 shown in FIG. 13.
Figure 15:
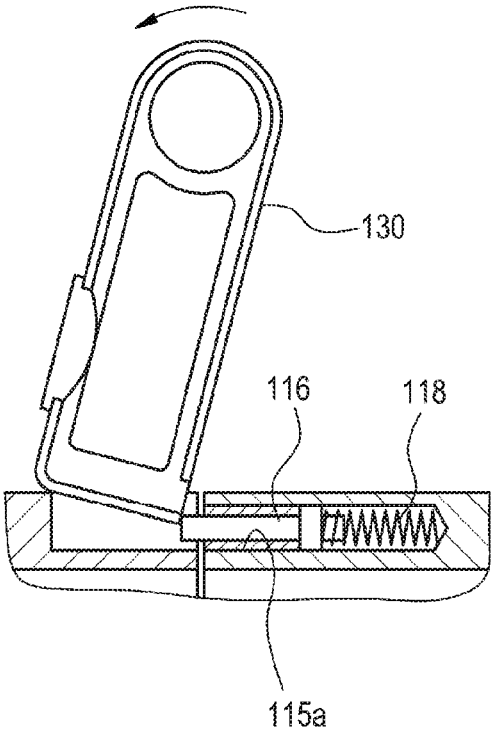
FIG. 15 PRIOR ART
FIG. 15 is a sectional view showing a state during an operation which is performed by a special tool to store the lock pin inside a pin support hole in order to release lock in the rotary connector according to the background art.
Figure 16:
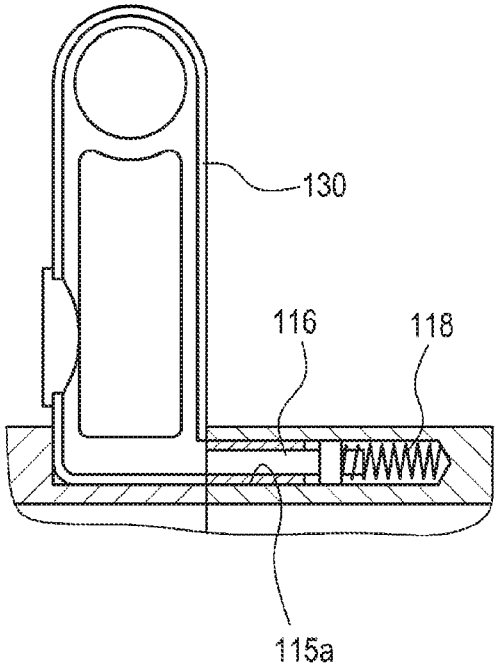
FIG. 16 PRIOR ART
FIG. 16 is a sectional view showing a state in which the lock pin has been stored inside the pin support hole by the special tool in order to release lock in the rotary connector according to the background art.

FIG. 1 to FIG. 10 show an embodiment of the rotary connector according to the invention. FIG. 1 is a perspective view of an assembled state of the embodiment of the rotary connector according to the invention. FIG. 2 is a view taken in the direction of an arrow A of FIG. 1. FIG. 3 is a sectional view taken along a line B-B of FIG. 2. FIG. 4 is an exploded perspective view of the rotary connector according to the embodiment of the invention. FIG. 5 is a perspective view of a state in which a first connector housing and a second connector housing are opposed to each other in the embodiment of the invention. FIG. 6 is a plan view of the state in which first connector housing and the second connector housing are opposed to each other in the embodiment of the invention. FIG. 7 is an external view of a state in which the connector housings have been fitted to each other axially and connection pins have arrived at distal ends of axial grooves of a second housing body. FIG. 8 is a sectional view taken along a line D-D of FIG. 7. FIG. 9 is an external view of a state in which connection between the connector housings has been locked in the embodiment of the invention. FIG. 10 is a sectional view taken along a line E-E of FIG. 9.

As shown in FIG. 1 to FIG. 5, the rotary connector 10 according to the embodiment is provided with a first connector housing 20 and a second connector housing 30. The second connector housing 30 is fitted and connected onto the first connector housing 20.

As shown in FIG. 3 and FIG. 4, the first connector housing 20 is provided with a first housing body 21, a front holder 22, an annular packing 23, a first rubber plug 24, and a rear holder 25. The first housing body 21 has a substantially cylindrical shape and houses a first terminal fitting 50 therein. The front holder 22 is fitted and mounted into an inner circumference of a distal end side (left side in FIG. 3) of the first housing body 21. The annular packing 23 is fitted and mounted onto an outer circumference of the distal end side of the first housing body 21. The first rubber plug 24 is fitted and mounted into the inner circumference of a proximal end (right end in FIG. 3) side of the first housing body 21. The rear holder 25 covers the proximal end of the first housing body 21.

The first terminal fitting 50 housed in the first housing body 21 is an abutment type terminal fitting whose distal end can be brought into abutment against a distal end of a mating terminal fitting so as to be connected to the mating terminal fitting electrically conductively. The first terminal fitting 50 is a press-molded product of a metal plate. As shown in FIG. 3, the first terminal fitting 50 is provided with a first terminal body 51, a first annular portion 52, and a plurality of contact spring pieces 53. The first terminal body 51 extends on a central axis of the first terminal fitting 50. The first annular portion 52 which is formed into an annular shape is provided at a distal end of the first terminal body 51. The plurality of contact spring pieces 53 are provided at a plurality of places in an outer circumference of the first annular portion 52.

An electric wire caulking piece 51*a* is provided at a proximal end of the first terminal body 51. An electric wire 71 is crimped and connected to the first terminal fitting 50 substantially coaxially with the central axis of the first terminal fitting 50. The first annular portion 52 formed at the distal end of the first terminal body 51 is formed into an annular shape concentric to the central axis of the first terminal fitting 50. In the contact spring pieces 53 provided in the outer circumference of the first annular portion 52, contact point protrusions are formed to protrude over elastic pieces which extend circumferentially along the outer circumference of the first annular portion 52. The contact point protrusions of the contact point spring pieces 53 are provided so that the contact point protrusions can protrude more closely to the mating terminal than a distal end of the first annular portion 52.

As shown in FIG. 3, the first housing body 21 includes a distal end-side cylinder portion 211, a body portion 212, and a proximal end cylinder portion 213. The front holder 22 is fitted into an inner circumference of the distal end-side cylinder portion 211. The body portion 212 has a cylindrical shape which ranges to a rear end of the distal end-side cylinder portion 211 and which has a larger outer diameter than the distal end-side cylinder portion 211. The proximal end cylinder portion 213 has a cylindrical shape which ranges to a rear end of the body portion 212 and which has a smaller outer diameter than the body portion 212.

Each of the distal end-side cylinder portion 211, the body portion 212 and the proximal end cylinder portion 213 has a circular outer circumference shape in cross section. In addition, the distal end-side cylinder portion 211, the body portion 212 and the proximal end cylinder portion 213 are shaped like concentric cylinders. In addition, the body portion 212 externally juts out in a flange shape on the proximal end side of the distal end-side cylinder portion 211.

As shown in FIG. 5, cuts 211*a* which are engaged with an outer circumference of a distal end of the first terminal fitting 50 to stop the first terminal fitting 50 from rotating are provided in a front end surface of the distal end-side cylinder portion 211.

In the case of the first housing body 21 according to the embodiment, connection pins 214 are provided at three circumferentially separate places in the outer circumference of the body portion 212. The connection pins 214 placed at the three places have columnar shapes. Each of the connection pins 214 is provided to protrude radially outward from the body portion 212. In addition, the three places where the connection pins 214 are provided are positions in which the outer circumference of the body portion 212 can be divided into three equal parts.

As shown in FIG. 3, lock protrusions 213*a* for locking the rear holder 25 are provided to protrude from the outer circumference of the proximal end cylinder portion 213 of the first housing body 21. The lock protrusions 213*a* are provided at two places in the outer circumference of the proximal end cylinder portion 213.

As shown in FIG. 3, the front holder 22 is fitted into the inner circumference of the front end side of the distal end-side cylinder portion 211 to determine the axial position of the first terminal fitting 50. The first terminal fitting 50 is fixed on a central axis C1 of the first housing body 21 through the front holder 22 so that the distal end surface of the first terminal fitting 50 can be exposed in a distal end of the distal end-side cylinder portion 211.

The packing 23 is fitted onto the outer circumference of the distal end-side cylinder portion 211. An outer circumference of the packing 23 closely adheres to a cylinder portion of a second housing body in the second connector housing 30 which will be described later, to thereby watertightly seal a fitting portion between the first housing body 21 and the second housing body 31.

As shown in FIG. 3, the first rubber plug 24 is fitted and mounted into an inner circumference of the proximal end cylinder portion 213 of the first housing body 21. A diameter of a section of the proximal end cylinder portion 213 where the first rubber plug 24 is mounted is expanded to be larger than an inner diameter of the proximal end cylinder portion 213 on the distal end-side cylinder portion 211 side. Thus, a step portion 213*b* is formed in the proximal end cylinder portion 213 so that the step portion 213*b* can abut against an outer circumferential edge of the first rubber plug 24. In the embodiment, the first rubber plug 24 watertightly seals a gap between an outer circumference of the electric wire 71 and a proximal end-side inner circumferential portion of the first housing body 21. The electric wire 71 is led to the outside from the proximal end side of the first housing body 21.

As shown in FIG. 4, the rear holder 25 is provided with a disk portion 251 and a cylinder portion 252. The disk portion 251 covers an opening of the proximal end cylinder portion 213. The cylinder portion 252 which extends from an outer circumference of the disk portion 251 is fitted onto the outer circumference of the proximal end cylinder portion 213. An electric wire insertion hole 253 is provided in the center of the disk portion 251 so that the electric wire 71 can be inserted through the electric wire insertion hole 253. Engagement holes 254 are formed in the cylinder portion 252 so that the engagement holes 254 can be engaged with the lock protrusions 213*a* on the proximal end cylinder portion 213. In the cylinder portion 252, slits 255 are provided in opposite sides of each of the engagement holes 254. A section where the engagement hole 254 is provided between the slits 255 is elastically deformed easily. The rear holder 25 attached to the proximal end cylinder portion 213 presses the first rubber plug 24, which has been mounted into the inner circumference of the proximal end cylinder portion 213, against the step portion 213*b* so as to fix the first rubber plug 24.

As shown in FIG. 3 and FIG. 4, the second connector housing 30 is provided with the second housing body 31, a front holder 32, a second rubber plug 34, and a rear holder 35. The second housing body 31 has a substantially cylindrical shape and houses a second terminal fitting 60 therein. The front holder 32 is fitted and mounted into an inner circumference of a distal end (right end in FIG. 3) side of the second housing body 31. The second rubber plug 34 is fitted and mounted into the inner circumference of a proximal end (left end in FIG. 3) side of the second housing body 31. The rear holder 35 covers the proximal end of the second housing body 31.

The second terminal filling 60 housed in the second housing body 31 is an abutment type terminal fitting whose distal end can be brought into abutment against the distal end of the first terminal fitting 50 so as to be connected to the first terminal fitting 50 electrically conductively. The second terminal fitting 60 is a press-molded product of a metal plate. As shown in FIG. 3, the second terminal fitting 60 is provided with a second terminal body 61, a second annular portion 62, and a plurality of contact faces 63. The second terminal body 61 extends on a central axis of the second terminal fitting 60. The second annular portion 62 which is formed into an annular shape is provided at a distal end of the second terminal body 61. The plurality of contact faces 63 are provided at a plurality of places in an outer circumference of the second annular portion 62.

An electric wire caulking piece 61*a* is provided at a proximal end of the second terminal body 61. An electric wire 72 is crimped and connected to the second terminal fitting 60 substantially coaxially with the central axis of the second terminal fitting 60. The second annular portion 62 formed at the distal end of the second terminal body 61 is formed into an annular shape concentric to the central axis of the second terminal fitting 60. The contact faces 63 provided in the outer circumference of the second annular portion 62 are arranged at the same intervals as the plurality of contact point protrusions in the first terminal fitting 50 so as to protrude from the outer circumference of the second annular portion 62 outward in the radial direction of the second annular portion 62. In addition, in the case of the second terminal fitting 60 according to the embodiment, a space between adjacent ones of the contact faces 63 serves as a contact point escape portion 64 (see FIG. 4) into which the contact point protrusion can sink.

As shown in FIG. 3, the second housing body 31 includes a cylinder portion 312, an intermediate cylinder portion 313, and a proximal end cylinder portion 314. The body portion 212 of the first connector housing 20 is fitted into the cylinder portion 312. The intermediate cylinder portion 313 ranges to a rear end of the cylinder portion 312. An inner diameter of the intermediate cylinder portion 313 is set to be smaller than the outer diameter of the body portion 212. The proximal end cylinder portion 314 ranges to a rear end of the intermediate cylinder portion 313 and serves as a reception portion for the second terminal fitting 60.

The cylinder portion 312 is located at the distal end of the second housing body 31. In the cylinder portion 312, axial grooves 315*a*, circumferential grooves 315*b* and lock spring pieces 316 are provided at three places corresponding to the positions on the body portion 212, where the connection pins 214 are provided.

The three places on the cylinder portion 312, where the axial grooves 315*a* are provided, are positions in which an outer circumference of the cylinder portion 312 can be divided into three equal parts.

As shown in FIG. 3 and FIG. 8, the axial grooves 315*a* are formed by cuts in the cylinder portion 312 so as to extend along a direction of a central axis O3 (see FIG. 6) of the cylinder portion 312 from an opening end of the cylinder portion 312. When the body portion 212 is fitted into the cylinder portion 312 along a direction of the central axis O3 of the cylinder portion 312 as designated by an arrow X1 in FIG. 5 and FIG. 6, the connection pins 214 on the body portion 212 enter the axial grooves 315*a*. The groove width of each axial groove 315*a* is set to be slightly larger than the outer diameter of each connection pin 214 so that the connection pin 214 can move smoothly in the axial groove 315*a*.

Incidentally, the central axis O3 of the aforementioned cylinder portion 312 is aligned with a central axis C2 of the second housing body 31 shown in FIG. 3.

As shown in FIG. 6 and FIG. 8, each circumferential groove 315*b* is arranged to extend with a predetermined length circumferentially toward one circumferential side (a lower side in FIG. 6 or a counterclockwise side in FIG. 8) of the cylinder portion 312 from a distal end of the axial groove 315*a*. The circumferential groove 315*b* is a groove in which the connection pin 214 can move when the cylinder portion 312 and the body portion 212 are rotated relatively to each other. The groove width of the circumferential groove 315*b* is set to be slightly larger than the outer diameter of the connection pin 214 so that the connection pin 214 can move smoothly in the circumferential groove 315*b*. Incidentally, the groove width in a distal end 315*f* (see FIG. 5) of the circumferential groove 315*b* is amended so that the connection pin 214 which has moved can come into close contact with a circular arc surface of the distal end.

In the case of the embodiment, as shown in FIG. 5, a connection wall 315*c* is provided on a radially outer side of the axial groove 315*a*. The connection wall 315*c* strides over the axial groove 315*a* to be connected to wall portions on opposite sides of the circumferential groove 315*b* so as to reinforce the circumference of the circumferential groove 315*b*.

As shown in FIG. 5, each lock spring piece (each lock portion in the invention) 316 is provided with a spring piece 316*a* and a lock protrusion 316*b*. The spring piece 316*a* is formed integrally with the cylinder portion 312 so as to extend along the aforementioned circumferential groove 315*b*. The lock protrusion 316*b* is formed integrally with the spring piece 316*a* so as to protrude into the circumferential groove 315*b*. In the case of the embodiment, the spring piece 316*a* a plate spring shape substantially bent into a doglegged shape. A doglegged bent portion of the spring piece 316*a* functions as the lock protrusion 316*b*.

As soon as the connection pin 214 arrives at the distal end 315*f* of the circumferential groove 315*b*, the lock protrusion 316*b* comes into elastic contact with the connection pin 214 from a start end side of the circumferential groove 315*b* so that the lock spring piece 316 can restrict the connection pin 214 from moving in a return direction (a direction of an arrow R1 in FIG. 9), as shown in FIG. 9.

In addition, assume that a pressing force F1 which is not lower than a predetermined value to act toward the start end side of the circumferential groove 315*b* is given to the lock protrusion 316*b* of the lock spring piece 316 according to the embodiment from the connection pin 214 positioned at the distal end 315*f* of the circumferential groove 315*b*, as shown in FIG. 9. In this case, the lock protrusion 316*b* exits from the circumferential groove 315*b* to allow the connection pin 214 to move toward the start end side of the circumferential groove 315*b*. That is, in the case of the embodiment, in the state in which connection between the second housing body 31 and the first housing body 21 is locked, a rotation operation force can be applied to the second housing body 31 or the first housing body 21 so that the connection pin 214 can return toward the start end side of the circumferential groove 315*b*. When the rotation operation force has reached or exceeded the predetermined value, the lock spring piece 316 retreats to the outside of the circumferential groove 315*b* so that the connection pin 214 can move toward the start end side of the circumferential groove 315*b*.

As shown in FIG. 3, the intermediate cylinder portion 313 in the second housing body 31 is a cylinder portion which houses the distal end-side cylinder portion 211 of the first housing body 21. An inner diameter of the intermediate cylinder portion 313 is set to be small enough so that the packing 23 can be held between the intermediate cylinder portion 313 and the distal end-side cylinder portion 211. An inner circumference of the packing 23 held between the intermediate cylinder portion 313 and the distal end-side cylinder portion 211 closely adheres to the distal end-side cylinder portion 211. The outer circumference of the packing 23 closely adheres to the intermediate cylinder portion 313 respectively. In this manner, the packing 23 can seal the fitting portion between the first housing body 21 and the second housing body 31 watertightly.

As shown in FIG. 3, an inner diameter of the proximal end cylinder portion 314 in the second housing body 31 is set to be smaller than the inner diameter of the intermediate cylinder portion 313. Not only is the second terminal fitting 60 housed in the proximal end cylinder portion 314, but the front holder 32 which can restrict the axial position of the second terminal fitting 60 is fitted and mounted into the proximal end cylinder portion 314 as well. The proximal end cylinder portion 314 fixedly supports the second terminal fitting 60 through the front holder 32 on the central axis C2 of the second housing body 31.

As shown in FIG. 3, lock protrusions 314*a* for locking the rear holder 35 are provided to protrude from an outer circumference of a proximal end of the proximal end cylinder portion 314. The lock protrusions 314*a* are provided at two places in the outer circumference of the proximal end cylinder portion 314.

As shown in FIG. 3, the second rubber plug 34 is fitted and mounted into an inner circumference of the proximal end of the proximal end cylinder portion 314. A diameter of a section of the proximal end cylinder portion 314 where the second rubber plug 34 is mounted is expanded to be larger than the inner diameter of the proximal end cylinder portion 314 on the front holder 32 side. Thus, a step portion 314*b* is formed in the proximal end cylinder portion 314 so that the step portion 314*b* can abut against an outer circumferential edge of the second rubber plug 34.

The second rubber plug 34 according to the embodiment watertightly seals a gap between an outer circumference of the electric wire 72 and a proximal end-side inner circumferential portion of the second housing body 31. The electric wire 72 is led to the outside from the proximal end side of the second housing body 31.

As shown in FIG. 4, the rear holder 35 is provided with a disk portion 351 and a cylinder portion 352. The disk portion 351 covers an opening of the proximal end cylinder portion 314. The cylinder portion 352 which extends from an outer circumference of the disk portion 351 is fitted onto the outer circumference of the proximal end cylinder portion 314. An electric wire insertion hole 353 is provided in the center of the disk portion 351 so that the electric wire 72 can be inserted through the electric wire insertion hole 353. Engagement holes 354 are formed in the cylinder portion 352 so that the engagement holes 354 can be engaged with the lock protrusions 314*a* on the proximal end cylinder portion 314. In the cylinder portion 352, slits 355 are provided in opposite sides of each of the engagement holes 354. A section where the engagement hole 254 is provided between the slits 355 is elastically deformed easily. As shown in FIG. 3, the rear holder 35 attached to the proximal end cylinder portion 314 presses the second rubber plug 34, which has been mounted into the inner circumference of the proximal end cylinder portion 314, against the step portion 313*b* so as to fix the second rubber plug 34.

Next, the procedure, function and effect for fitting and connecting the first connector housing 20 and the second connector housing 30 to each other in the rotary connector 10 according to the embodiment will be described based on FIG. 5 to FIG. 10.

First, as shown in FIG. 5 and FIG. 6, the first connector housing 20 and the second connector housing 30 are brought into a state to be opposed to each other so that the positions of the plurality of connection pins 214 of the body portion 212 of the first housing body 21 can be aligned with the positions of the plurality of axial grooves 315*a* of the cylinder portion 312 of the second housing body 31. Next, the second housing body 31 and the first housing body 21 are made to abut against each other along the direction of the central axis O3 of the cylinder portion 312 of the second housing body 31 as designated by the arrow X1 in FIG. 6, so that the second housing body 31 and the first housing body 21 can be brought into a fitting state, as shown in FIG. 7 and FIG. 8. The fitting state shown in FIG. 7 and FIG. 8 means a state in which the respective connection pins 214 have arrived at the distal ends of the corresponding axial grooves 315*a*.

Incidentally, although not shown, when the housing bodies 21 and 31 are in the fitting state shown in FIG. 7 and FIG. 8, the distal end portions of the first terminal fitting 50 and the second terminal fitting 60 fixedly supported by the respective housing bodies 21 and 31 abut against each other in the state in which the contact spring pieces 53 provided in the first terminal fitting 50 sink into the contact point escape portions 64 provided in the second terminal fitting 60.

Next, the housing bodies 21 and 31 are rotated relatively to each other to bring the connection pins 214 on the first housing body 21 to enter the circumferential grooves 315*b* on the second housing body 31 respectively. In this manner, the housing bodies 21 and 31 are restricted from moving axially relatively to each other so that the connector housing 20 and 30 can be brought into a state of connection to each other.

The housing bodies 21 and 31 are further rotated relatively to each other until the connection pins 214 arrive at the distal ends 315*f* of the circumferential grooves 315*b* respectively. In this manner, as shown in FIG. 9 and FIG. 10, the lock protrusions 316*b* of the lock spring pieces 316 come into elastic contact with the connection pins 214 from the start end sides of the circumferential grooves 315*b* to restrict the connection pins 214 from moving in the return direction. Accordingly, the connection state between the connector housings 20 and 30 is locked.

Incidentally, although not shown, when the housing bodies 21 and 31 are in the lock state shown in FIG. 9 and FIG. 10, the contact spring pieces 53 provided in the first terminal fitting 50 run onto the contact faces 63 provided in the second terminal fitting 60 so that the first terminal fitting 50 and the second terminal fitting 60 fixedly supported by the housing bodies 21 and 31 respectively can be brought into a state of electrically conductive connection to each other.

That is, in the rotary connector 10 according to the embodiment, the connection state between the connector housings is locked by the lock spring pieces 316 formed integrally with the cylinder portion 312 of the second connector housing 30. In other words, in the rotary connector 10 according to the embodiment, no separate component from the connector housings 20 and 30 is used for any lock mechanism. Thus, the number of constituent components can be reduced to thereby reduce cost, in comparison with the background-art rotary connector in which separate components from the connector housings are used for the lock mechanism.

In addition, according to the rotary connector 10 according to the embodiment, in the state in which the connection state between the housing bodies 21 and 31 has been locked as shown in FIG. 9 and FIG. 10, a rotation operation force may be applied between the housing bodies in an opposite direction to a direction of the force applied for the lock time. In this manner, a pressing force which is not lower than a predetermined value to act toward the start end sides of the circumferential grooves 315*b* is applied from the connection pins 214 to the lock protrusions 316*b* of the lock spring pieces 316. As a result, the lock protrusions 316*b* can exit from the circumferential grooves 315*b* to release the lock state so that the connection pins 214 can move toward the start end sides of the circumferential grooves 315*b*.

Accordingly, the housing bodies are operated and rotated relatively to each other until the connection pins 214 arrive at the start ends of the circumferential grooves 315*b* (i.e. the distal ends of the axial grooves 315*a*). Then, the housing bodies are pulled apart from each other axially so that the connector housings 20 and 30 can be brought into a state of detachment from each other.

That is, according to the rotary connector 10 according to the embodiment, the connector housings 20 and 30 can be attached/detached to/from each other easily by only axial movement operation and circumferential rotation operation without using any tool.

In addition, according to the rotary connector 10 according to the embodiment, the lock spring pieces 316 which serve as lock mechanisms are arranged to extend circumferentially on the cylinder portion 312 of the second connector housing 30 so as not to occupy a large axial space in the connector housing 30. Therefore, the axial length of the second connector housing 30 having the lock spring pieces 316 can be reduced so that the total length of the connector can be reduced. Accordingly, it is also possible to improve mountability of the connector on a vehicle in which it is difficult to secure a sufficient installation space.

In addition, according to the rotary connector 10 according to the embodiment, the inside of the connector can be maintained in a waterproof state by the first rubber plug 24 provided at the proximal end of the first connector housing 20, the packing 23 provided in the fitting portion between the connector housings and the second rubber plug 34 provided at the proximal end of the second connector housing 30, as shown in FIG. 3, in the state in which the connection state between the connector housings 20 and 30 is locked. Accordingly, the connector can be used satisfactorily also for wiring connection in an engine room etc. requiring waterproofness in a vehicle etc.

Incidentally, the invention is not limited to the aforementioned embodiment but may be carried out with modification, improvement, etc. made thereon suitably. In addition thereto, the materials, the shapes, the dimensions, the numbers, the arrangement places etc. of the respective constituent elements in the aforementioned embodiment are not limited but may be set desirably as long as the invention can be achieved.

For example, the first terminal fitting and the second terminal fitting which serve as abutment type terminal fittings may be designed to have the following structure. That is, when abutment between the connector housings shown in FIGS. 7 and 8 is completed, the distal end faces of the terminal fittings abut against each other to come into a state of electrically conductive connection to each other.

In addition, the aforementioned embodiment has a configuration in which the connection pins 214 are provided in the first housing body 21, and the axial grooves 315*a*, the circumferential grooves 315*b* and the lock spring pieces 316 are provided in the second housing body 31. However, configuration may be made alternatively so that the connection pins 214 are provided in the second housing body 31, and the axial grooves 315*a*, the circumferential grooves 315*b* and the lock spring pieces 316 are provided in the first housing body 21. In this case, the connection pins 214 provided in the second housing body 31 are provided to protrude radially inward.

In addition, the aforementioned embodiment has a configuration in which the connection pins 214 and the lock spring pieces 316 are provided in the housing bodies 21 and 31 respectively. However, one connection pin 214 and one lock spring piece 316 may be provided in the housing bodies 21 and 31 respectively alternatively.

In addition, the lock portion 316 may be constituted not by the spring piece 316*a* and the lock protrusion 316*b* as in the aforementioned embodiment but by only the lock protrusion 316*b* which juts into the circumferential groove 315*b* while a cut-off portion is omitted and the spring piece 316*a* is therefore omitted. In this case, the connection pin 214 can pass through a section inside the circumferential groove 315*b* narrowed by the lock protrusion 316*b* in a pressure contact state.

In addition, the terminal fittings housed in the connector housings respectively are not limited to the abutment type. For example, one terminal fitting may be made to have a structure in which contact point portions are disposed on an outer circumferential surface of a column portion provided in one housing and the other terminal fitting may be made to have a structure in which contact point portions are disposed on an inner circumferential surface of a cylinder portion of the other housing into which the column portion is fitted. Thus, the structures can be made so that the contact point portions are brought into contact with each other when the housings are operated and rotated relatively to each other.

The aforementioned characteristics of the embodiment of the rotary fitting connector according to the invention will be summarized here briefly in the following (1) to (3).

(1) A rotary connector (10) including:

a first connector housing (20) including:

a first housing body (21) which has a circular outer circumference shape in cross section and which houses a first terminal fitting (50) therein; and a connection pin (214) which is provided to protrude radially outward from the first housing body (21); and a second connector housing (30) including:

a second housing body (31) which has a circular outer circumference shape in cross section, into which the first housing body (21) is fitted, and which houses a second terminal fitting (60) connected to the first terminal fitting (50);

an axial groove (315*a*) which is formed by cut to extend along a direction of a central axis of the second housing body (31) from an end portion of the second housing body (31) on the first connector housing (20) side, and which allows the connection pin (214) to enter therein when the first housing body (21) is fitted into the second housing body (31) along the direction of the central axis of the second housing body (31);

a circumferential groove (315*b*) which is arranged to extend circumferentially toward one circumferential side of the second housing body (31) from a distal end of the axial groove (315*a*), and which allows the connection pin (214) to move therein when the second housing body (31) and the first housing body (21) are rotated relatively to each other; and a lock portion (316) which is provided to protrude into the circumferential groove (315*b*), and which contacts the connection pin (214) from a start end side of the circumferential groove (315*b*) to restrict the connection pin (214) from moving in a return direction in a state in which the connection pin (214) arrives at a distal end of the circumferential groove (315*b*), wherein when a pressing force which is not lower than a predetermined value to act toward the start end side of the circumferential groove (315*b*) is given to the lock portion (316) from the connection pin (214) positioned at the distal end of the circumferential groove (315*b*), the lock portion (316) allows the connection pin (214) to move toward the start end side of the circumferential groove (315*b*).

(2) The rotary connector (10) according to the aforementioned (1), further including:

a first rubber plug (24) which watertightly seals a gap between an outer circumference of an electric wire (71) led to the outside from a proximal end side of the first housing body (21) and a proximal end-side inner circumferential portion of the first housing body (21);

a second rubber plug (34) which watertightly seals a gap between an outer circumference of an electric wire (72) led to the outside from a proximal end side of the second housing body (31) and a proximal end-side inner circumferential portion of the second housing body (31); and a packing (23) which is provided in a fitting portion between the first housing body (21) and the second housing body (31) to watertightly seal the fitting portion between the first housing body (21) and the second housing body (31).

(3) A rotary connector (10) including:

a first connector housing (20) including:

a first housing body (21) including a body portion (212) which has a circular outer circumference in cross section, and which houses a first terminal fitting (50) therein; and a plurality of connection pins (214) which are provided at circumferentially separate places in an outer circumference of the body portion (212) to protrude radially outward from the body portion (212); and a second connector housing (30) including:

a second housing body (31) which includes a cylinder portion (312) into which the body portion (212) is fitted, and which houses a second terminal fitting (60) connected to the first terminal fitting (50);

a plurality of axial grooves (315*a*) which are formed by cuts to extend along a direction of a central axis of the cylinder portion (312) from an opening end of the cylinder portion (312), and which allow the connection pins (214) to enter therein when the body portion (212) is fitted into the cylinder portion (312) along the direction of the central axis of the cylinder portion (312);

a plurality of circumferential grooves (315*b*) which are arranged to extend circumferentially toward one circumferential side of the cylinder portion (312) from distal ends of the axial grooves (315*a*), and which allow the connection pins (214) to move therein when the cylinder portion (312) and the body portion (212) are rotated relatively to each other; and a plurality of lock spring pieces (316), each of which includes a spring piece (316*a*) formed integrally with the cylinder portion (312) so as to extend along the circumference groove (315*b*), and a lock protrusion (316*b*) formed integrally with the spring piece (316*a*) to protrude into the circumferential groove (315*b*), such that the lock protrusions (316*b*) elastically contact the connection pins (214) from start end sides of the circumferential grooves (315*b*) to restrict the connection pins (214) from moving in a return direction in a state in which the connection pins (214) arrive at distal ends of the circumferential grooves (315*b*), wherein when a pressing force which is not lower than a predetermined value to act toward the start end sides of the circumferential grooves (315*b*) is given to the lock protrusions (316*b*) of the lock spring pieces (316) from the connection pins (214) positioned at the distal ends of the circumferential grooves (315*b*), the lock protrusions (316*b*) exit from the circumferential grooves (315*b*) to allow the connection pins (214) to move toward the start end sides of the circumferential grooves (315*b*).

Although the invention has been described in detail and with reference to a specific embodiment, it is obvious to those skilled in the art that various changes or modifications may be made on the invention without departing from the spirit and scope of the invention.

The present application is based on a Japanese patent application (Patent Application No. 2013-139098) which was filed on Jul. 2, 2013 and the contents of which are incorporated herein by reference.

INDUSTRIAL APPLICABILITY

According to the rotary connector according to the invention, the number of constituent components can be reduced to thereby reduce cost, the connector housings can be attached/detached to/from each other easily without using any tool, and further, the total length of the connector can be shortened to thereby improve mountability of the connector on a vehicle. The invention which can achieve the effect is useful for a rotary connector in which connector housings fitted to each other can be rotated relatively to each other to thereby lock a connection state between the connector housings.

DESCRIPTION OF REFERENCE SIGNS

10 Rotary Connector
20 First Connector Housing
21 First Housing Body
23 Packing
24 First Rubber Plug
30 Second Connector Housing
31 Second Housing Body
34 Second Rubber Plug
50 First Terminal Fitting
60 Second Terminal Fitting
212 Body Portion
214 Connection Pin
312 Cylinder Portion
315*a* Axial Groove
315*b* Circumferential Groove
316 Lock Spring Piece
316*a* Spring Piece
316*b* Lock Protrusion

The invention claimed is:

1. A rotary connector comprising:

a first connector housing comprising:

a first housing body which has a circular outer circumference shape in cross section and which houses a first terminal fitting therein; and a connection pin provided to protrude radially outward from the first housing body; and a second connector housing comprising:

a second housing body which has a circular outer circumference shape in cross section, into which the first housing body is fitted, and which houses a second terminal fitting connected to the first terminal fitting;

an axial groove which is formed by a cut to extend along a direction of a central axis of the second housing body from an end portion of the second housing body on the first connector housing side, and which allows the connection pin to enter therein when the first housing body is fitted into the second housing body along the direction of the central axis of the second housing body;

a circumferential groove which is arranged to extend circumferentially toward one circumferential side of the second housing body from a distal end of the axial groove, and which allows the connection pin to move therein when the second housing body and the first housing body are rotated relatively to each other; and a lock portion which is provided to protrude into the circumferential groove, which elastically deforms away from the circumferential groove and into a gap, between the lock portion and the second housing body, by contacting the connection pin located at a position between a start end and a distal end of the circumferential groove, and which contacts the connection pin from a start end side of the circumferential groove to restrict the connection pin from moving in a return direction in a state in which the connection pin arrives at the distal end of the circumferential groove, wherein when a pressing force which is not lower than a predetermined value to act toward the start end side of the circumferential groove is given to the lock portion from the connection pin positioned at the distal end of the circumferential groove, the lock portion allows the connection pin to move toward the start end side of the circumferential groove.

2. The rotary connector according to claim 1, further comprising:

a first rubber plug which watertightly seals a gap between an outer circumference of an electric wire led to the outside from a proximal end side of the first housing body and a proximal end-side inner circumferential portion of the first housing body;

a second rubber plug which watertightly seals a gap between an outer circumference of an electric wire led to the outside from a proximal end side of the second housing body and a proximal end-side inner circumferential portion of the second housing body; and a packing which is provided in a fitting portion between the first housing body and the second housing body to watertightly seal the fitting portion between the first housing body and the second housing body.

3. The rotary connector according to claim 1, wherein the lock portion is formed in a dog legged shape and longitudinally extends from the start end side of the circumferential groove to the distal end of the circumferential groove.

4. The rotary connector according to claim 1, further comprising a plurality of other lock portions each provided to respective other axial grooves and other circumferential grooves and configured to respectively protrude into ones of the other circumferential grooves, and to elastically deform away from the ones of the other circumferential grooves and into respective gaps, between ones of the other lock portions and the second housing body, by contacting ones of a plurality of other connection pins located at a position between start ends and distal ends of the ones of the other circumferential grooves, and to contact the ones of the other connection pins from a start end side of the other circumferential grooves to restrict the ones of the other connection pins from moving in the return direction in a state in which the ones of the other connection pins arrive at the distal ends of the ones of the other circumferential grooves.

* * * * *